US012275062B2

(12) United States Patent
Ichinohe et al.

(10) Patent No.: US 12,275,062 B2
(45) Date of Patent: Apr. 15, 2025

(54) INJECTION MOLDING COMPOSITION, METHOD FOR PRODUCING INJECTION MOLDED BODY, AND METHOD FOR PRODUCING TITANIUM SINTERED BODY

(71) Applicant: SEIKO EPSON CORPORATION, Tokyo (JP)

(72) Inventors: Yuki Ichinohe, Hachinohe (JP); Yuki Oshima, Hachinohe (JP)

(73) Assignee: SEIKO EPSON CORPORATION, Tokyo (JP)

( * ) Notice: Subject to any disclaimer, the term of this patent is extended or adjusted under 35 U.S.C. 154(b) by 23 days.

(21) Appl. No.: 17/663,990

(22) Filed: May 18, 2022

(65) Prior Publication Data

US 2022/0371088 A1 Nov. 24, 2022

(30) Foreign Application Priority Data

May 18, 2021 (JP) ..... 2021-083697

(51) Int. Cl.

| | |
|---|---|
| ***B22F 1/12*** | (2022.01) |
| ***B22F 1/05*** | (2022.01) |
| ***B22F 1/103*** | (2022.01) |
| ***B22F 3/10*** | (2006.01) |
| ***B22F 3/22*** | (2006.01) |
| ***C22C 1/04*** | (2023.01) |
| ***C22C 1/05*** | (2023.01) |

(52) U.S. Cl.

CPC ..... *B22F 1/12* (2022.01); *B22F 1/05* (2022.01); *B22F 1/103* (2022.01); *B22F 3/1021* (2013.01); *B22F 3/225* (2013.01); *B22F 2301/205* (2013.01); *B22F 2302/256* (2013.01); *B22F 2304/10* (2013.01); *C22C 1/0458* (2013.01); *C22C 1/05* (2013.01)

(58) Field of Classification Search

CPC .... B22F 1/12; B22F 1/05; B22F 1/103; B22F 3/1021; B22F 3/225; B22F 2301/205; B22F 2302/256; B22F 2304/10; B22F 3/15; B22F 2003/247; B22F 2999/00; B22F 1/10; B22F 3/1017; C22C 1/0458; C22C 1/05

See application file for complete search history.

(56) References Cited

U.S. PATENT DOCUMENTS

| | | | | |
|---|---|---|---|---|
| 5,984,683 | A * | 11/1999 | Sakata | A61K 6/84 623/924 |
| 11,998,978 | B1 * | 6/2024 | Hundley | B22F 1/06 |
| 2019/0111482 | A1 * | 4/2019 | Djemai | B22F 1/054 |

FOREIGN PATENT DOCUMENTS

JP 2009142594 A 7/2009

* cited by examiner

*Primary Examiner* — John A Hevey
(74) *Attorney, Agent, or Firm* — CHIP LAW GROUP

(57) ABSTRACT

An injection molding composition contains a titanium-based powder containing titanium as a main component and having an average particle diameter of 15 μm or more and 35 μm or less, a ceramic powder containing a ceramic as a main material and having an average particle diameter of 1 nm or more and 100 nm or less, and an organic binder. The ceramic is an oxide-based ceramic containing an oxide as a main component, and a standard free energy of formation of the oxide at 1000° C. may be lower than a standard free energy of formation of titanium oxide at 1000° C.

4 Claims, 4 Drawing Sheets

INJECTION MOLDING COMPOSITION, METHOD FOR PRODUCING INJECTION MOLDED BODY, AND METHOD FOR PRODUCING TITANIUM SINTERED BODY

The present application is based on, and claims priority from JP Application Serial Number 2021-083697, filed May 18, 2021, the disclosure of which is hereby incorporated by reference herein in its entirety.

BACKGROUND

1. Technical Field

The present disclosure relates to an injection molding composition, a method for producing an injection molded body, and a method for producing a titanium sintered body.

2. Related Art

Titanium alloys are excellent in mechanical strength, corrosion resistance, and low Young's modulus, and are thus used in the fields of aircraft, space development, chemical plants, watch external components, decorative articles such as eyeglass frames, sporting goods such as golf clubs, and the like.

When producing such a component, a titanium sintered body having a shape close to a final shape can be easily produced by using a powder metallurgy method. Accordingly, secondary processing can be omitted or the amount of processing can be reduced, and efficient component production becomes possible.

For example, JP-A-2009-142594 discloses a method for producing hairstyling scissors including obtaining an injection molded body by a metal powder injection molding method (MIM method) using a molding material containing a metal powder made of precipitation hardened stainless steel and an organic binder, subjecting the injection molded body to a debindering treatment to obtain a debindered body, and firing the debindered body to obtain a sintered body. According to such a method, hairstyling scissors can be produced by using the precipitation hardening stainless steel which is considered to be unsuitable for hairstyling scissors because of having too high Rockwell hardness.

In such an MIM method, in order to improve quality of the finally obtained sintered body, it is important to uniformly mix the metal powder and the organic binder in the molding material. However, a titanium powder containing titanium or a titanium-based alloy has a property of being difficult to be uniformly mixed with the organic binder. Therefore, an uneven distribution of the organic binder is likely to occur in the molding material. In particular, the uneven distribution of the organic binder tends to occur in a site where a wall thickness rapidly changes or in the vicinity of a gate of a mold.

When the uneven distribution of the organic binder occurs, a quantitative balance between the titanium powder and the organic binder is lost at the site, and the amount of the organic binder is relatively increased. As a result, molding defects occur, and in the sintered body obtained by sintering the obtained molded body, surface properties are deteriorated, for example, metallic luster and aesthetic appearance are deteriorated.

SUMMARY

An injection molding composition according to an application example of the present disclosure contains: a titanium-based powder containing titanium as a main component and having an average particle diameter of 15 μm or more and 35 μm or less; a ceramic powder containing a ceramic as a main material and having an average particle diameter of 1 nm or more and 100 nm or less; and an organic binder.

A method for producing an injection molded body according to an application example of the present disclosure includes: obtaining an injection molding composition by mixing a titanium-based powder containing titanium as a main component and having an average particle diameter of 15 μm or more and 35 μm or less, a ceramic powder containing a ceramic as a main material and having an average particle diameter of 1 nm or more and 100 nm or less, and an organic binder; and subjecting the injection molding composition to injection molding to obtain an injection molded body.

A method for producing a titanium sintered body according to the application example of the present disclosure includes: debindering the injection molded body according to the application example of the present disclosure to obtain a debindered body; and sintering the debindered body to obtain a sintered body.

DESCRIPTION OF EXEMPLARY EMBODIMENTS

Figure 1:
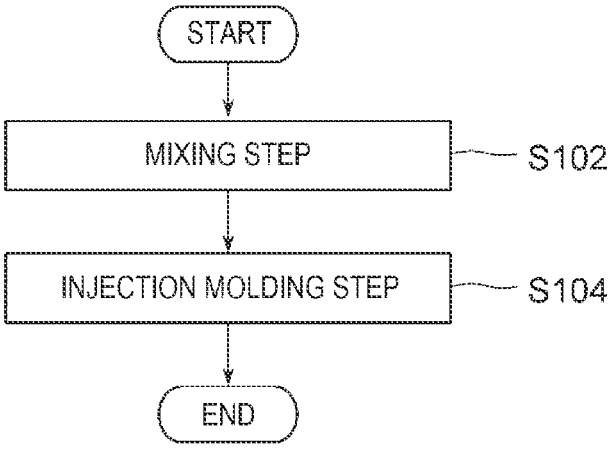
FIG. 1 is a process diagram illustrating a method for producing an injection molded body according to an embodiment.

Hereinafter, an injection molding composition, a method for producing an injection molded body, and a method for producing a titanium sintered body according to the present disclosure will be described in detail based on the drawings.

1. Injection Molding Composition

First, an injection molding composition according to an embodiment will be described.

The injection molding composition according to the embodiment is a molding material to be subjected to a metal powder injection molding method, and contains a titanium-based powder, a ceramic powder, and an organic binder.

The titanium-based powder is a powder containing titanium as a main component and having an average particle diameter of 15 μm or more and 35 μm or less. The ceramic powder is a powder containing a ceramic as a main material and having an average particle diameter of 1 nm or more and 100 nm or less.

In such an injection molding composition, when the titanium-based powder and the ceramic powder are mixed with each other, particles of the ceramic powder are interposed between particles of the titanium-based powder. Accordingly, a problem that the titanium-based powder and the organic binder are difficult to mix with each other is solved. Specifically, the particles of the ceramic powder having a diameter smaller than that of the particles of the titanium-based powder are distributed on surfaces of the particles of the titanium-based powder. Then, the particles of the ceramic powder make the particles of the titanium-based powder and the organic binder easy to slip over each other, and fluidity of the particles of the ceramic powder and the particles of the titanium-based powder is improved, and the titanium-based powder and the organic binder are easily mixed uniformly with each other. Further, the ceramic powder is interposed between the particles of the titanium-based powder, and frictional resistance is reduced, which also contributes to improvement of ease of mixing. As a result, a more homogeneous injection molding composition is obtained.

The homogeneous injection molding composition prevents occurrence of molding defects due to uneven distribution of the organic binder. Accordingly, an injection molded body having excellent surface properties can be obtained, and finally, a titanium sintered body having excellent surface properties can be produced.

1.1. Composition 1.1.1. Titanium-Based Powder

The titanium-based powder contained in the injection molding composition is a powder containing titanium as a main component and having an average particle diameter of 15 μm or more and 35 μm or less.

Examples of a constituent material of the titanium-based powder include a titanium simple substance and a titanium-based alloy.

The titanium-based alloy is an alloy containing titanium as a main component, and is an alloy containing, in addition to titanium (Ti), for example, an element such as carbon (C), nitrogen (N), oxygen (O), aluminum (Al), vanadium (V), niobium (Nb), zirconium (Zr), tantalum (Ta), molybdenum (Mo), chromium (Cr), manganese (Mn), cobalt (Co), iron (Fe), silicon (Si), gallium (Ga), tin (Sn), barium (Ba), nickel (Ni), and sulfur (S).

Specific examples of a composition of the titanium-based alloy include compositions defined as type 60, type 60E, type 61, or type 61F in JIS H 4600:2012. Specific examples thereof include Ti-6Al-4V, Ti-6Al-4V ELI, and Ti-3Al-2.5V. In addition, specific examples thereof include Ti-6Al-6V-2Sn, Ti-6Al-2Sn-4Zr-2Mo-0.08Si, and Ti-6Al-2Sn-4Zr-6Mo defined in an aerospace material standard (AMS). Specific examples thereof include Ti-5Al-2.5Fe and Ti-6Al-7Nb which are defined in a standard defined by international organization for standardization (ISO). Further, specific examples thereof include Ti-13Zr-13Ta, Ti-6Al-2Nb-1Ta, Ti-15Zr-4Nb-4Ta, and Ti-5Al-3Mo-4Zr.

In expression of alloy compositions described above, a component having a higher concentration is described in the order from the left, and a numeral present in front of an element is a concentration of the element represented by mass %. For example, Ti-6Al-4V contains 6 mass % of Al and 4 mass % of V, and the balance is Ti and impurities. The impurities refer to elements that are inevitably mixed or intentionally added and a total concentration thereof is 0.40 mass % or less.

Details of the main alloy compositions are as follows.

The Ti-6Al-4V alloy contains Al in an amount of 5.5 mass % or more and 6.75 mass % or less, and V in an amount of 3.5 mass % or more and 4.5 mass % or less, the balance being Ti and impurities. As the impurities, for example, Fe is allowed to be contained in a proportion of 0.4 mass % or less, O is allowed to be contained in a proportion of 0.2 mass % or less, N is allowed to be contained in a proportion of 0.05 mass % or less, H (hydrogen) is allowed to be contained in a proportion of 0.015 mass % or less, and C is allowed to be contained in a proportion of 0.08 mass % or less. Other elements are allowed to be individually contained in a proportion of 0.10 mass % or less, and a total of 0.40 mass % or less.

The Ti-6Al-4V ELI alloy contains Al in an amount of 5.5 mass % or more and 6.5 mass % or less, and V in an amount of 3.5 mass % or more and 4.5 mass % or less, the balance being Ti and impurities. As the impurities, for example, Fe is allowed to be contained in a proportion of 0.25 mass % or less, O is allowed to be contained in a proportion of 0.13 mass % or less, N is allowed to be contained in a proportion of 0.03 mass % or less, H is allowed to be contained in a proportion of 0.0125 mass % or less, and C is allowed to be contained in a proportion of 0.08 mass % or less. Other elements are allowed to be individually contained in a proportion of 0.10 mass % or less, and a total of 0.40 mass % or less.

The Ti-3Al-2.5V alloy contains Al in an amount of 2.5 mass % or more and 3.5 mass % or less, V in an amount of 1.6 mass % or more and 3.4 mass % or less, S in an amount of 0.05 mass % or more and 0.20 mass % or less as necessary, and at least one of La (lanthanum), Ce (cerium), Pr (praseodymium), and Nd (neodymium) in a total proportion of 0.05 mass % or more and 0.70 mass % or less of as necessary, the balance being Ti and impurities. As the impurities, for example, Fe is allowed to be contained in a proportion of 0.30 mass % or less, O is allowed to be contained in a proportion of 0.25 mass % or less, N is allowed to be contained in a proportion of 0.05 mass % or less, H is allowed to be contained in a proportion of 0.015 mass % or less, and C is allowed to be contained in a proportion of 0.10 mass % or less. Other elements are allowed to be contained in a total proportion of 0.40 mass % or less.

The Ti-5Al-2.5Fe alloy contains Al in an amount of 4.5 mass % or more and 5.5 mass % or less, and Fe in an amount of 2.0 mass % or more and 3.0 mass % or less, the balance being Ti and impurities. As the impurities, for example, O is allowed to be contained in a proportion of 0.2 mass % or less, N is allowed to be contained in a proportion of 0.05 mass % or less, H is allowed to be contained in a proportion of 0.013 mass % or less, and C is allowed to be contained in a proportion of 0.08 mass % or less. Other elements are allowed to be contained in a total proportion of 0.40 mass % or less.

The Ti-6Al-7Nb alloy contains Al in an amount of 5.5 mass % or more and 6.5 mass % or less, and Nb in an amount of 6.5 mass % or more and 7.5 mass % or less, the balance being Ti and impurities. As the impurities, for example, Ta is allowed to be contained in a proportion of 0.50 mass % or less, Fe is allowed to be contained in a proportion of 0.25 mass % or less, O is allowed to be contained in a proportion of 0.20 mass % or less, N is allowed to be contained in a proportion of 0.05 mass % or less, H is allowed to be contained in a proportion of 0.009 mass % or less, and C is allowed to be contained in a proportion of 0.08 mass % or less. Other elements are allowed to be contained in a total proportion of 0.40 mass % or less.

Components contained in the titanium-based powder can be analyzed, for example, by a method in accordance with a titanium-ICP emission spectrometry method defined in JIS H 1632-1:2014 to JIS H 1632-3:2014.

The average particle diameter of the titanium-based powder is 15 μm or more and 35 μm or less as described above, preferably 18 μm or more and 32 μm or less, and more preferably 20 μm or more and 30 μm or less.

When the average particle diameter of the titanium-based powder is less than the above lower limit, a rolling property of the particles of the titanium-based powder tends to decrease, and fluidity of the injection molding composition may decrease. When the average particle diameter of the titanium-based powder is more than the above upper limit, the particles of the titanium-based powder become large, so that a filling property into a mold may decrease depending on a molding shape.

The average particle diameter of the titanium-based powder is measured as follows. First, the injection molding composition is magnified and observed at a magnification of 100 times or more. Then, in an observation image, an area of a particle image of the titanium-based powder is measured. Next, a diameter of a perfect circle having the same area as the above area is obtained. The obtained diameter is defined as a particle diameter of the particle image. In this way, the particle diameter is obtained for ten or more particle images, and an average value is calculated. The calculated average value is defined as the average particle diameter of the titanium-based powder.

When the constituent material of the titanium-based powder is a titanium-based alloy, the titanium-based powder may be a powder (pre-alloy powder) consisting of only particles having a single alloy composition, or may be a mixed powder (premixed powder) obtained by mixing a plurality of kinds of particles having different compositions from each other.

1.1.2. Ceramic Powder

The ceramic powder contained in the injection molding composition is a powder containing a ceramic as a main material and having an average particle diameter of 1 nm or more and 100 nm or less.

Examples of the ceramic include oxide-based ceramics such as aluminum oxide, magnesium oxide, titanium oxide, zirconium oxide, silicon oxide, iron oxide, potassium oxide, sodium oxide, calcium oxide, chromium oxide, and niobium oxide, nitride-based ceramics such as boron nitride and silicon nitride, and silicon carbide, and one or more of these ceramics are used.

Among these, the ceramic is preferably an oxide-based ceramic containing an oxide as a main component. A standard free energy of formation of the oxide at 1000° C. is preferably lower than a standard free energy of formation of the titanium oxide at 1000° C.

Accordingly, when the injection molding composition is molded and further sintered, titanium contained in the titanium-based powder reduces the oxide contained in the ceramic powder. As a result, the ceramic powder is less likely to remain in the titanium sintered body as it is. That is, when the oxide is reduced and becomes a simple substance of a metal or a simple substance of a non-metal, the ceramic is highly likely to be solid-solved in a matrix phase of the titanium sintered body. Meanwhile, when the ceramic powder remains as it is, depending on a composition of the ceramic, the ceramic powder may be present as an inclusion in the titanium sintered body. Such an inclusion may inhibit an increase in sintered density of the titanium sintered body or may reduce mechanical characteristics of the titanium sintered body.

Therefore, the injection molding composition that can be used for producing the titanium sintered body excellent in surface properties and mechanical characteristics can be obtained by using the above oxide-based ceramic having the standard free energy of formation.

The oxide is preferably silicon oxide. When silicon oxide is reduced by titanium, silicon is generated. When silicon is solid-solved in the matrix phase of the titanium sintered body, an improvement in mechanical characteristics such as tensile strength is facilitated, and the surface properties of the titanium sintered body is less likely to be adversely influenced. Further, a silicon oxide powder is relatively easily available and is inexpensive.

The average particle diameter of the ceramic powder is 1 nm or more and 100 nm or less as described above, preferably 3 nm or more and 50 nm or less, and more preferably 5 nm or more and 20 nm or less. When the average particle diameter of the ceramic powder is within the above range, the ceramic powder is likely to be distributed on particle surfaces of the titanium-based powder. In addition, the particles of the ceramic powder distributed on the particle surfaces of the titanium-based powder roll, and the slip between the particles of the titanium-based powder and the organic binder can be improved. Further, slip between particles of the titanium-based powder is also improved. As a result, the fluidity of the injection molding composition can be improved. Further, even if the ceramic powder remains in the titanium sintered body, since a particle diameter of the inclusion is sufficiently small, an influence on the surface properties and the mechanical characteristics of the titanium sintered body can be minimized.

When the average particle diameter of the ceramic powder is less than the above lower limit, the particles of the ceramic powder are less likely to roll. Therefore, the above effects may not be obtained. Meanwhile, when the average particle diameter of the ceramic powder is more than the above upper limit, the inclusion derived from the ceramic powder tends to inhibit the sintering of the injection molding composition, or a part of the ceramic may remain even if the ceramic is reduced by titanium, and the surface properties of the titanium sintered body may be deteriorated.

The average particle diameter of the ceramic powder is preferably 0.01% or more and 0.50% or less of the average particle diameter of the titanium-based powder, more preferably 0.02% or more and 0.40% or less of the average particle diameter of the titanium-based powder, and still more preferably 0.03% or more and 0.30% or less of the average particle diameter of the titanium-based powder.

Accordingly, an injection molding composition capable of improving the surface properties and the mechanical characteristics of the titanium sintered body can be obtained.

A ratio of the ceramic powder in the total amount of the titanium-based powder and the ceramic powder is not particularly limited, and is preferably 0.01 mass % or more and 0.30 mass % or less, more preferably 0.02 mass % or more and 0.20 mass % or less, and still more preferably 0.03 mass % or more and 0.15 mass % or less. By setting the ratio of the ceramic powder within the above range, an effect of adding the ceramic powder can be sufficiently obtained, and the influence of the inclusion derived from the ceramic powder can be minimized. In particular, when the oxide-based ceramic is used, the inclusion can be easily prevented from remaining.

When the ratio of the ceramic powder is less than the above lower limit, the effect of adding the ceramic powder may not be sufficiently obtained. Meanwhile, when the ratio of the ceramic powder is more than the above upper limit, the molding defects of the injection molded body are likely to occur, and the surface properties and the mechanical characteristics of the titanium sintered body may be deteriorated.

The average particle diameter of the ceramic powder is measured in the same manner as the average particle diameter of the titanium-based powder.

The ceramic powder may be subjected to a surface treatment as necessary. Examples of the surface treatment include a hydrophobic treatment, a coupling agent treatment, and an organosilazane treatment. By subjecting the ceramic powder to the hydrophobic treatment, adsorption of water to the ceramic powder is prevented. Therefore, occurrence of aggregation in the ceramic powder can be further prevented. By subjecting the ceramic powder to the coupling agent treatment or the organosilazane treatment, characteristics depending on functional groups contained in a coupling agent or organosilazane can be imparted. For example, affinity between the ceramic powder and the organic binder can be improved, hydrophobicity of the ceramic powder can be improved, or the aggregation of the ceramic powder can be prevented.

Examples of the hydrophobic treatment include trimethylsilylation, and arylation such as phenylation. In the trimethylsilylation, for example, a trimethylsilylating agent such as trimethylchlorosilane is used. In the arylation, for example, an arylating agent such as an aryl halide is used.

Examples of the coupling agent treatment include a treatment using a coupling agent containing an alkyl group, a methacrylic group, an epoxy group, an amino group, a vinyl group, a phenyl group or a mercapto group as a functional group.

Examples of the organosilazane treatment include a treatment using organosilazane such as tetramethyldisilazane, hexamethyldisilazane, and pentamethyldisilazane.

1.1.3. Organic Binder

A content of the organic binder in the injection molding composition is appropriately set according to molding conditions, shapes to be molded, and the like, and is preferably about 2 mass % or more and 20 mass % or less of the injection molding composition, and more preferably about 5 mass % or more and 10 mass % or less of the injection molding composition. By setting the content of the organic binder within the above range, the injection molding composition has good fluidity. Accordingly, the filling property of the injection molding composition at the time of molding is improved, and a titanium sintered body having a shape close to a finally-intended shape is obtained.

Examples of the organic binder include various resins such as polyolefin such as polyethylene, polypropylene, and an ethylene-vinyl acetate copolymer, acrylic resins such as polymethyl methacrylate and polybutyl methacrylate, styrene-based resins such as polystyrene, polyvinyl chloride, polyvinylidene chloride, polyamide, polyesters such as polyethylene terephthalate and polybutylene terephthalate, polyether, polyvinyl alcohol, polyvinyl pyrrolidone, and copolymers thereof, and various organic binders such as various kinds of wax, paraffin, higher fatty acid, higher alcohol, higher fatty acid ester, and higher fatty acid amide. One or a mixture of two or more of these organic binders can be used.

1.1.4. Additive

A plasticizer may be added to the injection molding composition as necessary. Examples of the plasticizer include a phthalic acid ester, an adipic acid ester, a trimellitic acid ester, and a sebacic acid ester, and one or a mixture of two or more of these plasticizers can be used.

In addition to the titanium-based powder, the organic binder, and the plasticizer, various additives such as a lubricant, an antioxidant, a debindering accelerator, and a surfactant may be added to the injection molding composition as necessary.

A content of the additive in the injection molding composition is preferably 10.0 mass % or less, and more preferably 5.0 mass % or less 1.2. Physical Properties As described above, the injection molding composition according to the embodiment has improved fluidity due to the addition of the ceramic powder. A melt viscosity of the injection molding composition contributes to the improvement in fluidity.

The melt viscosity of the injection molding composition at a measurement weight of 100 g, a measurement temperature of 150° C., and a measurement speed of 100 mm/min is preferably 50 Pa·s (500 Poise) or more and 100 Pa·s (1000 Poise) or less, and more preferably 60 Pa·s (600 Poise) or more and 90 Pa·s (900 Poise) or less. By keeping the melt viscosity of the injection molding composition within the above range, the molding defects due to the uneven distribution of the organic binder is prevented from occurring in injection molding regardless of the shape of the mold.

The melt viscosity of the injection molding composition is measured by, for example, a melt viscosity measurement apparatus Capillograph 1B manufactured by Toyo Seiki Seisaku-sho, Ltd.

2. Method for Producing Injection Molded Body

Next, a method for producing the injection molded body according to the embodiment will be described.

FIG. 1 is a process diagram illustrating a method for producing the injection molded body according to the embodiment.

The method for producing the injection molded body illustrated in FIG. 1 includes a mixing step S102 and an injection molding step S104.

2.1. Mixing Step

In the mixing step S102, the titanium-based powder, the ceramic powder, and the organic binder are mixed with each other.

An order of mixing is not particularly limited, and preferably, first, the titanium-based powder and the ceramic powder are mixed to obtain a mixed powder. That is, prior to mixing with the organic binder, the titanium-based powder and the ceramic powder are premixed to obtain a premixed powder. A known mixer is used for the mixing. The mixing is preferably performed in a dry state (dry blending). The dry state refers to a state in which the mixed powder does not contain a liquid that is present independently, that is, a state in which the mixed powder does not contain a liquid that is present without being adsorbed on the surfaces of the particles of the titanium-based powder and the ceramic powder. By mixing in such a state, the aggregation of the ceramic powder due to the liquid is prevented, and the titanium-based powder and the ceramic powder can be more uniformly mixed with each other.

Figure 2:
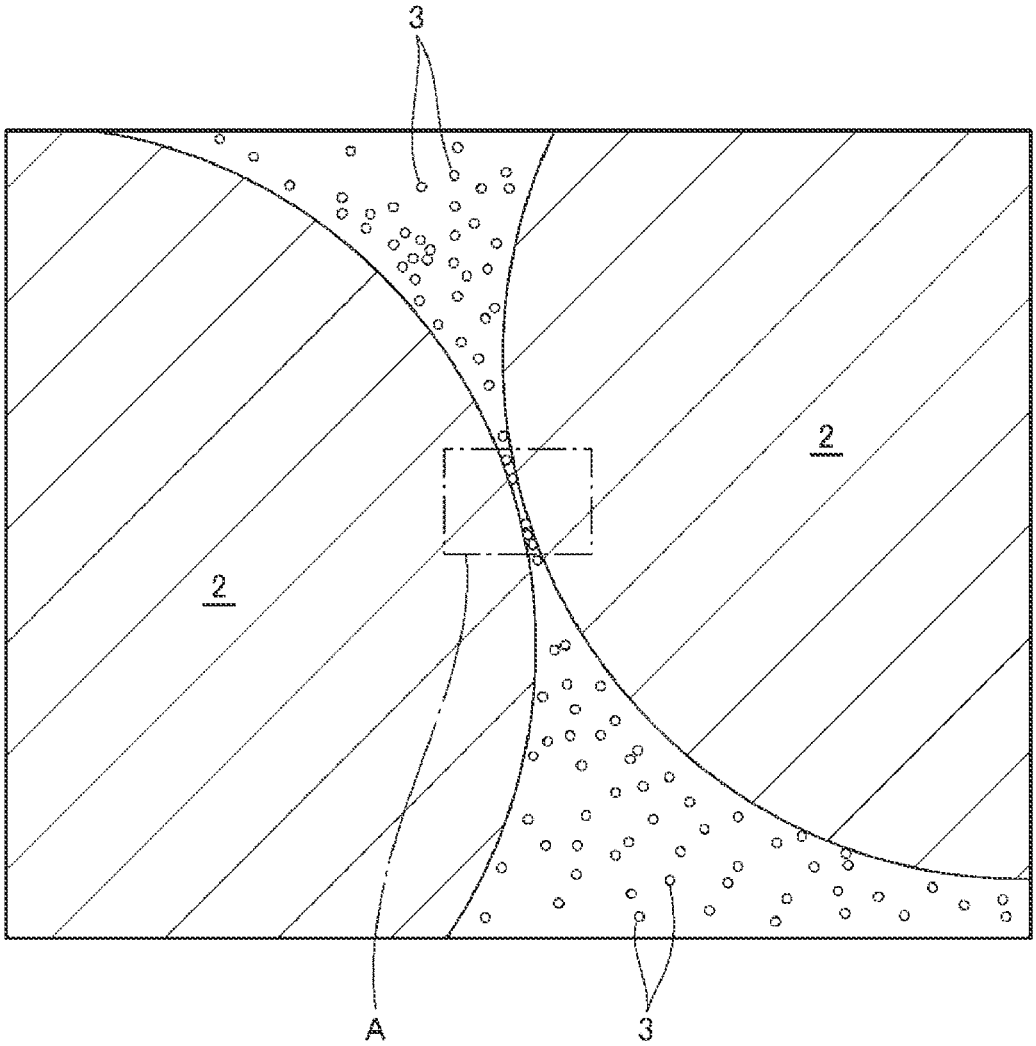
FIG. 2 is an enlarged cross-sectional view of a mixed powder of a titanium-based powder and a ceramic powder obtained in a mixing step illustrated in FIG. 1.
Figure 3:
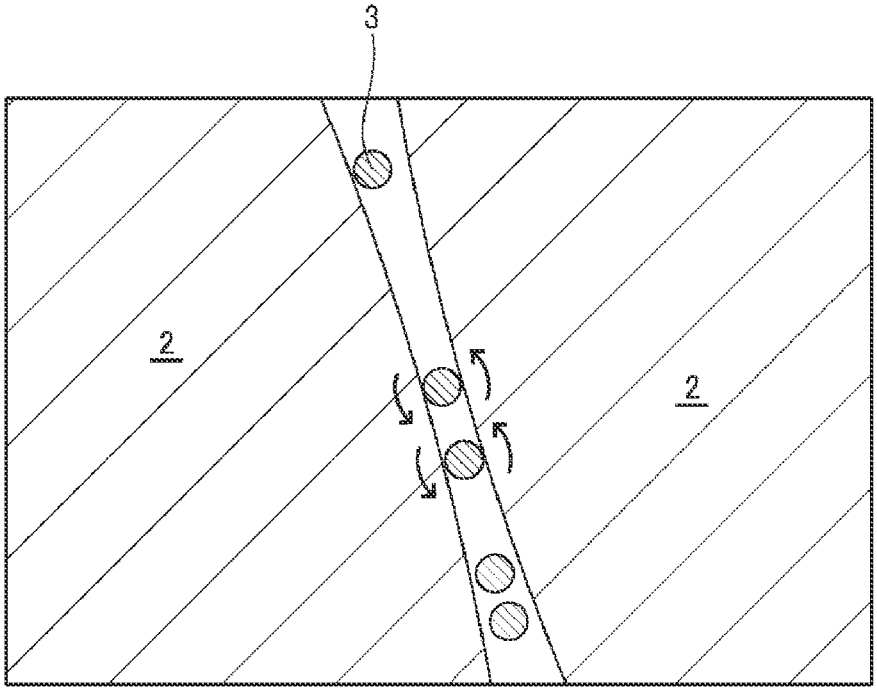
FIG. 3 is an enlarged view of a portion A in FIG. 2.

FIG. 2 is an enlarged cross-sectional view of the mixed powder of the titanium-based powder and the ceramic powder obtained in the mixing step S102 illustrated in FIG. 1. FIG. 3 is an enlarged view of a portion A in FIG. 2. In the following description, the particles of the titanium-based powder are referred to as "titanium particles 2", and the particles of the ceramic powder are referred to as "ceramic particles 3".

As illustrated in FIGS. 2 and 3, the ceramic particles 3 are interposed between the titanium particles 2 in the mixed powder. Accordingly, the ceramic particles 3 act like rollers between the titanium particles 2. As a result, the ceramic particles 3 prevent adjacent titanium particles 2 from inhibiting respective rolling thereof. Accordingly, the fluidity of the titanium particles 2 and the ceramic particles 3 is improved, and a homogeneous mixed powder can be obtained.

In order to cause the ceramic particles 3 to act like rollers, as illustrated in FIG. 3, it is preferable that the ceramic particles 3 are interposed as a single layer between the titanium particles 2. Accordingly, the ceramic particles 3 are likely to roll particularly along the surfaces of the adjacent titanium particles 2.

In order to cause the ceramic particles 3 to act as described above, it is preferable to keep an addition amount of the ceramic particles 3 within the above range. By optimizing the addition amount of the ceramic particles 3, a state illustrated in FIG. 3 can be easily realized.

When the ratio of the ceramic powder is less than the above lower limit, the action may not be sufficiently obtained, and when the ratio of the ceramic powder is more than the above upper limit, the ceramic particles 3 are stacked in multiple layers between the titanium particles 2.

Figure 4:
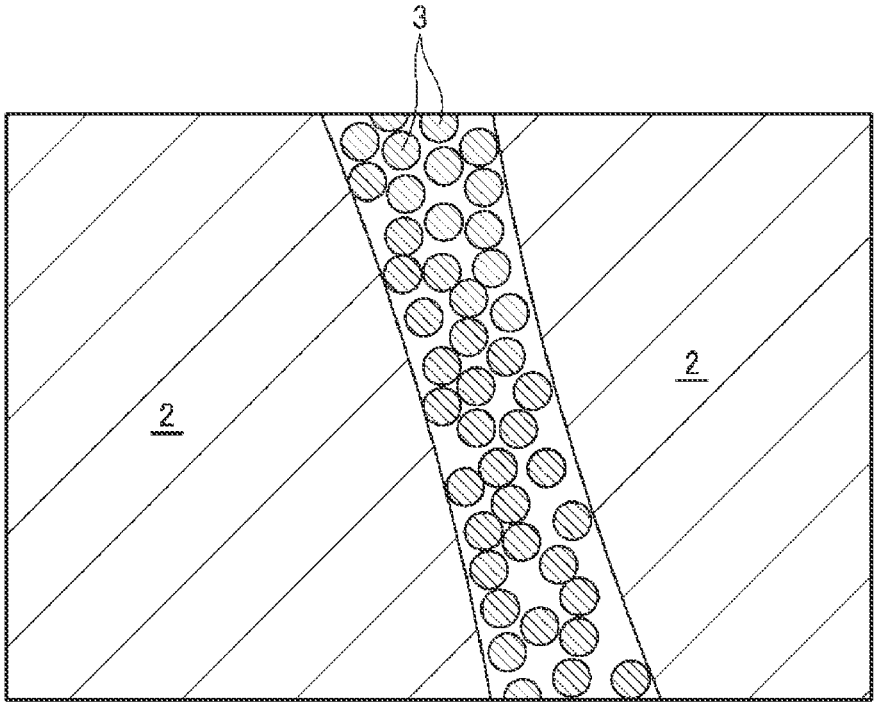
FIG. 4 is a cross-sectional view illustrating a state in which an addition amount of ceramic particles illustrated in FIG. 3 is excessive.

FIG. 4 is a cross-sectional view illustrating a state in which the addition amount of the ceramic particles 3 illustrated in FIG. 3 is excessive. That is, FIG. 4 illustrates a state in which the addition amount of the ceramic particles 3 is more than the above upper limit.

When the ceramic particles 3 are excessively added, the ceramic particles 3 interposed between the titanium particles 2 are stacked in multiple layers, as illustrated in FIG. 4. Therefore, the ceramic particles 3 are less likely to roll due to the frictional resistance between the ceramic particles 3. As a result, depending on the particle diameter of the titanium particles 2 and the particle diameter of the ceramic particles 3, the fluidity of the titanium particles 2 and the ceramic particles 3 may not be improved.

Next, the obtained mixed powder is mixed with the organic binder and kneaded. Accordingly, the injection molding composition is obtained.

The injection molding composition may be a mixture, or may be a kneaded product obtained by kneading the mixture as described above. Kneading conditions differ depending on the particle diameter of the titanium-based powder to be used, the particle diameter and the addition amount of the ceramic powder, the composition and the addition amount of the organic binder, and the like. For example, a kneading temperature is set to about 50° C. or higher and 200° C. or lower, and a kneading time is set to about 15 minutes or longer and 210 minutes or shorter.

The injection molding composition is formed into pellets (small masses) as necessary. A particle diameter of the pellet is, for example, about 1 mm or more and 15 mm or less.

2.2. Injection Molding Step

In the injection molding step S104, the obtained kneaded product is injection molded to obtain an injection molded body.

In molding, a metal powder injection molding (MIM) method is used. Injection molding conditions differ depending on the particle diameter of the titanium-based powder to be used, the particle diameter and the addition amount of the ceramic powder, the composition and the addition amount of the organic binder, and the like. For example, a material temperature is preferably about 80° C. or higher and 210° C. or lower, and an injection pressure is preferably about 50 MPa or more and 500 MPa or less (0.5 t/cm$^2$ or more and 5 t/cm$^2$ or less).

A shape and a dimension of the injection molded body are determined in consideration of shrinkage of the injection molded body in a debindering step and a sintering step to be described later.

The injection molded body may be subjected to machining such as grinding, polishing, or cutting as necessary. The injection molded body is easier to process than the titanium sintered body.

As described above, the method for producing the injection molded body according to the present embodiment includes the mixing step S102 and the injection molding step S104. In the mixing step S102, the injection molding composition is obtained by mixing the titanium-based powder, the ceramic powder, and the organic binder. The titanium-based powder is a powder containing titanium as a main component and having an average particle diameter of 15 μm or more and 35 μm or less. The ceramic powder is a powder containing a ceramic as a main material and having an average particle diameter of 1 nm or more and 100 nm or less. In the injection molding step S104, the injection molding composition is injection molded to obtain an injection molded body.

According to such a configuration, when the titanium-based powder and the ceramic powder are mixed with each other in the mixing step S102, the particles of the ceramic powder are interposed between the particles of the titanium-based powder. Accordingly, a problem that the titanium-based powder and the organic binder are difficult to mix with each other is solved. Further, the ceramic powder is interposed between the particles of the titanium-based powder, and the frictional resistance is reduced, which also contributes to improvement of ease of mixing. As a result, a more homogeneous injection molding composition is obtained.

The homogeneous injection molding composition prevents the occurrence of the molding defects due to the uneven distribution of the organic binder. Accordingly, an injection molded body having excellent surface properties can be obtained, and finally, a titanium sintered body having excellent surface properties can be produced.

3. Method for Producing Titanium Sintered Body

Next, a method for producing the titanium sintered body according to the embodiment will be described.

Figure 5:
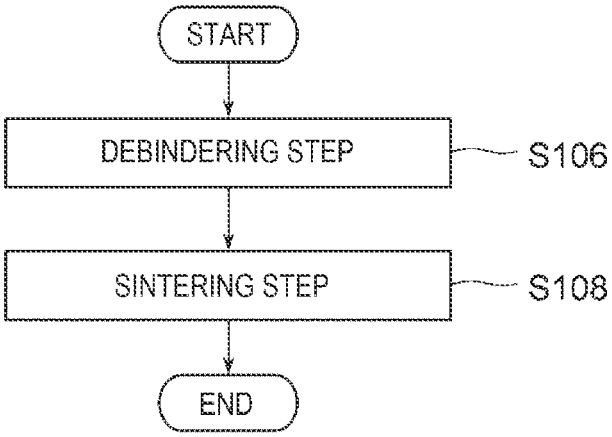
FIG. 5 is a process diagram illustrating a method for producing a titanium sintered body according to the embodiment.

FIG. 5 is a process diagram illustrating the method for producing the titanium sintered body according to the embodiment.

The method for producing the titanium sintered body illustrated in FIG. 5 includes a debindering step S106 and a sintering step S108.

3.1. Debindering Step

In the debindering step S106, the obtained injection molded body is subjected to a debindering treatment to remove at least a part of the organic binder to obtain a debindered body.

Examples of the debindering treatment include a method of heating the injection molded body, and a method of exposing the injection molded body to a gas that decomposes the binder.

When the method of heating the injection molded body is used, although heating conditions for the injection molded body slightly differ depending on the composition and the addition amount of the organic binder, it is preferable that a heating temperature is about 100° C. or higher and 750° C. or lower and a heating time is about 0.1 hours or longer and 20 hours or shorter, and it is more preferably that the heating temperature is about 150° C. or higher and 600° C. or lower and the heating time is about 0.5 hours or longer and 15 hours or shorter. Accordingly, the injection molded body can be debindered in a necessary and sufficient manner without being sintered or deformed.

An atmosphere in the debindering treatment is not particularly limited, and examples thereof include a reducing gas atmosphere such as hydrogen, an inert gas atmosphere such as nitrogen and argon, an oxidizing gas atmosphere such as air, or a decompressed atmosphere obtained by decompressing these atmospheres. Among these, from the viewpoint of preventing oxidation of titanium, the inert gas atmosphere or the decompressed atmosphere is preferably used.

Examples of the gas that decomposes the binder include ozone gas.

By performing such a debindering step separately in a plurality of steps under different debindering conditions, the debindering treatment can be performed so as to more quickly remove the organic binder in the injection molded body without deforming the injection molded body.

The debindered body may be subjected to machining such as grinding, polishing, or cutting as necessary. The debindered body is easier to process than the titanium sintered body.

3.2. Sintering Step

In the sintering step S108, the obtained debindered body is fired in a firing furnace to obtain a sintered body. Accordingly, diffusion occurs at interfaces between the particles of the titanium-based powder, leading to sintering. As a result, a titanium sintered body is obtained.

A firing temperature differs depending on a composition, the particle diameter, and the like of the titanium-based powder. For example, the firing temperature is about 900° C. or higher and 1400° C. or lower. The firing temperature is preferably about 1050° C. or higher and 1300° C. or lower.

A firing time is 0.2 hours or longer and 7 hours or shorter, and is preferably about 1 hour or longer and 6 hours or shorter.

A firing atmosphere is not particularly limited, and in consideration of preventing remarkable oxidation of the metal powder, a reducing gas atmosphere such as hydrogen, an inert gas atmosphere such as nitrogen or argon, a decompressed atmosphere obtained by decompressing these atmospheres or the like is preferably used.

The firing temperature or the atmosphere in the firing treatment described later may be changed during the sintering step.

As described above, the method for producing the titanium sintered body according to the present embodiment includes the debindering step S106 and the sintering step S108. In the debindering step S106, the injection molded body is debindered to obtain a debindered body. In the sintering step S108, the debindered body is sintered to obtain a sintered body.

According to such a configuration, the molding defects due to the uneven distribution of the organic binder is prevented from occurring in the injection molded body. Therefore, the generation of low-density portions due to the molding defects is prevented, and a titanium sintered body excellent in surface properties can be obtained.

3.3. Post-Step

The titanium sintered body obtained as described above may be subjected to a post-treatment as necessary. The post-treatment is not particularly limited, and examples thereof include a HIP treatment (hot isotropic pressure treatment) and a polishing treatment. The HIP treatment can further increase the density of the titanium sintered body and further improve the mechanical characteristics.

Examples of conditions in the HIP treatment include conditions that a heating temperature is 850° C. or higher and 1200° C. or lower and a heating time is 1 hour or longer and 10 hours or shorter. Further, a pressurizing force is preferably 50 MPa or more, and more preferably 100 MPa or more and 500 MPa or less.

Examples of the polishing treatment include electrolytic polishing, buff polishing, dry polishing, chemical polishing, barrel polishing, and sandblasting. By performing these polishing treatments, metallic luster is imparted to the surface of the titanium sintered body, and specularity can be improved. Further, by improving the specularity, sliding resistance on the surface of the titanium sintered body is reduced, and wear resistance of the titanium sintered body can be improved.

The injection molding composition, the method for producing the injection molded body, and the method for producing the titanium sintered body according to the present disclosure are described based on preferred embodiments, but the present disclosure is not limited thereto. For example, the mixing step may include an operation of mixing a composition containing the titanium-based powder and the organic binder and a composition containing the ceramic powder and the organic binder. In the method for producing the injection molded body and the method for producing the titanium sintered body according to the present disclosure, any desired steps may be added to the above embodiment.

EXAMPLES

Next, specific examples of the present disclosure will be described.

4. Production of Titanium Sintered Body 4.1. Example 1

4.1.1. Mixing Step

First, as the titanium-based powder, a pure Ti powder having an average particle diameter of 23 μm produced by a gas atomizing method was prepared. A titanium concentration of the pure Ti powder was 99 mass % or more.

As the ceramic powder, a silicon oxide powder (silica powder) having an average particle diameter of 10 nm was prepared. A main material of the silica powder was silicon oxide (SiO or $SiO_2$) .

As the organic binder, a mixture of polypropylene and paraffin wax was prepared. A ratio of the total mass of the titanium-based powder and the ceramic powder to the mass of the organic binder was 9:1.

Next, the titanium-based powder and the ceramic powder were mixed with each other in a mixer to obtain a mixed powder.

Next, the obtained mixed powder and the organic binder were kneaded by a kneader to obtain an injection molding composition. Thereafter, the obtained injection molding composition was processed into pellets.

4.1.2. Injection Molding Step

Next, the obtained pellets were injection molded under the following molding conditions to obtain an injection molded body.

Molding method: metal powder injection molding method

Material temperature: 150° C.

4.1.3. Debindering Step

Next, the obtained injection molded body was subjected to a debindering treatment under the debindering conditions shown below to obtain a debindered body.

Heating temperature in debindering treatment: 520° C.

Heating time in debindering treatment: 5 hours

Atmosphere in debindering treatment: nitrogen gas atmosphere 4.1.4. Sintering Step Next, the obtained debindered body was sintered under the following firing conditions to obtain a titanium sintered body. Production conditions are shown in Table 1.

4.2. Examples 2 to 31

Titanium sintered bodies were obtained in the same manner as in Example 1 except that the production conditions were changed as shown in Tables 1 to 3. The term "batch mixing" described in each table refers to a method of collectively mixing the titanium-based powder, the ceramic powder, and the organic binder as a mixing method in the mixing step.

4.3. Comparative Examples 1 to 12

Titanium sintered bodies were obtained in the same manner as in Examples except that the production conditions were changed as shown in Tables 1 to 3. In Comparative Examples 1, 5, and 9, addition of the ceramic powder was omitted.

4.4. Reference Examples 1 to 3

A molten material of pure Ti was prepared as Reference Example 1. A molten material of a Ti-6Al-4V alloy was prepared as Reference Example 2. A molten material of a Ti-6Al-7Nb alloy was prepared as Reference Example 3.

5. Evaluation of Titanium Sintered Body 5.1. Evaluation of Surface Properties

Surface properties of each of the titanium sintered bodies of Examples and Comparative Examples were observed with an optical microscope. Observation results of the surface properties were evaluated in light of the following evaluation criteria.

A: the surface properties are very good (aesthetic appearance is particularly excellent).

B: the surface properties are slightly good (the aesthetic appearance is slightly excellent).

C: the surface properties are slightly poor (the aesthetic appearance is slightly inferior).

D: the surface properties are very poor (the aesthetic appearance is particularly inferior).

Evaluation results are shown in Tables 1 to 3.

5.2. Evaluation of Mechanical Strength

Tensile strength was measured for each of the titanium sintered bodies of Examples and Comparative Examples and the titanium molten materials of Reference Examples. The tensile strength was measured according to a metal material tensile test method defined in JIS Z 2241:2011.

Next, the tensile strength obtained for each of the titanium molten materials of Reference Examples 1 to 3 was set to a reference value 1, and a relative value of the tensile strength obtained for each of the titanium sintered bodies of Examples and Comparative Examples was calculated. The relative values were calculated by using the tensile strength of Reference Example 1 as a reference value in Table 1, the tensile strength of Reference Example 2 as a reference value in Table 2, and the tensile strength of Reference Example 3 as a reference value in Table 3. The obtained relative values were evaluated in light of the following evaluation criteria.

A: the relative value of the tensile strength is 1.00 or more (equal to or greater than the molten material).

B: the relative value of the tensile strength is 0.97 or more and less than 1.00.

C: the relative value of the tensile strength is 0.94 or more and less than 0.97.

D: the relative value of the tensile strength is 0.91 or more and less than 0.94.

E: the relative value of the tensile strength is 0.88 or more and less than 0.91.

F: the relative value of the tensile strength is less than 0.88.

Evaluation results are shown in Tables 1 to 3.

TABLE 1

| | Producing condition for titanium sintered body | | | | | | | | | Evaluation result of titanium sintered body | |
|---|---|---|---|---|---|---|---|---|---|---|---|
| | Titanium-based powder | | Ceramic powder | | | | | | Melt viscosity of injection molding composition | | |
| | Composition — | Average particle diameter μm | Composition — | Standard free energy of formation — | Average particle diameter nm | Particle diameter ratio % | Content mass % | Mixing method — | Pa · s | Surface properties — | Tensile strength — |
| Example 1 | Pure Ti | 23 | Silicon oxide | Lower than titanium oxide | 10 | 0.043 | 0.01 | Premix | 95 | A | C |
| Example 2 | Pure Ti | 23 | Silicon oxide | Lower than titanium oxide | 10 | 0.043 | 0.03 | Premix | 90 | A | B |
| Example 3 | Pure Ti | 23 | Silicon oxide | Lower than titanium oxide | 10 | 0.043 | 0.05 | Premix | 84 | A | A |
| Example 4 | Pure Ti | 23 | Silicon oxide | Lower than titanium oxide | 10 | 0.043 | 0.10 | Premix | 85 | A | A |
| Example 5 | Pure Ti | 23 | Silicon oxide | Lower than titanium oxide | 10 | 0.043 | 0.30 | Premix | 92 | A | B |
| Example 6 | Pure Ti | 23 | Silicon oxide | Lower than titanium oxide | 10 | 0.043 | 0.50 | Premix | 98 | B | D |
| Example 7 | Pure Ti | 23 | Silicon oxide | Lower than titanium oxide | 3 | 0.013 | 0.05 | Premix | 88 | A | B |

TABLE 1-continued

| | Producing condition for titanium sintered body | | | | | | | | | Evaluation result of titanium sintered body | |
|---|---|---|---|---|---|---|---|---|---|---|---|
| | Titanium-based powder | | Ceramic powder | | | | | | Melt viscosity of injection molding composition | | |
| | Composition — | Average particle diameter μm | Composition — | Standard free energy of formation — | Average particle diameter nm | Particle diameter ratio % | Content mass % | Mixing method — | Pa · s | Surface properties — | Tensile strength — |
| Example 8 | Pure Ti | 23 | Silicon oxide | Lower than titanium oxide | 5 | 0.022 | 0.05 | Premix | 85 | A | B |
| Example 9 | Pure Ti | 23 | Silicon oxide | Lower than titanium oxide | 20 | 0.087 | 0.05 | Premix | 89 | A | A |
| Example 10 | Pure Ti | 23 | Silicon oxide | Lower than titanium oxide | 50 | 0.217 | 0.05 | Premix | 94 | B | B |
| Example 11 | Pure Ti | 23 | Silicon oxide | Lower than titanium oxide | 80 | 0.348 | 0.05 | Premix | 99 | C | B |
| Example 12 | Pure Ti | 23 | Niobium oxide | Lower than titanium oxide | 30 | 0.130 | 0.05 | Premix | 93 | A | B |
| Example 13 | Pure Ti | 23 | Aluminum oxide | Higher than titanium oxide | 50 | 0.217 | 0.05 | Premix | 96 | C | D |
| Example 14 | Pure Ti | 23 | Silicon nitride | — | 10 | 0.043 | 0.05 | Premix | 88 | C | D |
| Example 15 | Pure Ti | 18 | Silicon oxide | Lower than titanium oxide | 10 | 0.056 | 0.05 | Premix | 84 | A | A |
| Example 16 | Pure Ti | 30 | Silicon oxide | Lower than titanium oxide | 10 | 0.033 | 0.05 | Premix | 85 | A | A |
| Example 17 | Pure Ti | 30 | Silicon oxide | Lower than titanium oxide | 10 | 0.033 | 0.05 | Premix | 68 | C | C |
| Example 18 | Pure Ti | 30 | Silicon oxide | Lower than titanium oxide | 10 | 0.033 | 0.05 | Premix | 45 | C | C |
| Example 19 | Pure Ti | 23 | Silicon oxide | Lower than titanium oxide | 10 | 0.043 | 0.05 | Batch mixing | 91 | B | C |
| Comparative Example 1 | Pure Ti | 10 | — | — | — | — | — | — | 105 | D | E |
| Comparative Example 2 | Pure Ti | 10 | Silicon oxide | Lower than titanium oxide | 10 | 0.100 | 0.05 | Premix | 102 | D | E |
| Comparative Example 3 | Pure Ti | 50 | Silicon oxide | Lower than titanium oxide | 10 | 0.020 | 0.05 | Premix | 104 | D | E |
| Comparative Example 4 | Pure Ti | 23 | Silicon oxide | Lower than Titanium oxide | 150 | 0.652 | 0.10 | Premix | 106 | D | F |
| Reference Example 1 | Molten Material of Pure Ti | | — | — | — | — | — | — | — | — | D |

TABLE 2

| | Producing condition for titanium sintered body | | | | | | | | | | |
|---|---|---|---|---|---|---|---|---|---|---|---|
| | Titanium-based powder | | Ceramic powder | | | | | | Melt viscosity of injection molding composition | Evaluation result of titanium sintered body | |
| | Composition — | Average particle diameter μm | Composition — | Standard free energy of formation — | Average particle diameter nm | Particle diameter ratio % | Content mass % | Mixing method — | Pa · s | Surface properties — | Tensile strength — |
| Example 20 | Ti—6Al—4V | 20 | Silicon oxide | Lower than titanium oxide | 10 | 0.050 | 0.03 | Premix | 88 | A | B |
| Example 21 | Ti—6Al—4V | 20 | Silicon oxide | Lower than titanium oxide | 10 | 0.050 | 0.05 | Premix | 82 | A | A |
| Example 22 | Ti—6Al—4V | 20 | Silicon oxide | Lower than titanium oxide | 10 | 0.050 | 0.10 | Premix | 83 | A | A |
| Example 23 | Ti—6Al—4V | 20 | Aluminum oxide | Higher than titanium oxide | 50 | 0.250 | 0.05 | Premix | 94 | C | D |
| Example 24 | Ti—6Al—4V | 20 | Silicon nitride | — | 10 | 0.050 | 0.05 | Premix | 87 | C | D |
| Example 25 | Ti—6Al—4V | 20 | Silicon oxide | Lower than titanium oxide | 10 | 0.050 | 0.05 | Batch mixing | 89 | B | C |
| Comparative Example 5 | Ti—6Al—4V | 12 | — | — | — | — | — | — | 104 | D | D |
| Comparative Example 6 | Ti—6Al—4V | 12 | Silicon oxide | Lower than titanium oxide | 10 | 0.083 | 0.05 | Premix | 101 | D | E |
| Comparative Example 7 | Ti—6Al—4V | 48 | Silicon oxide | Lower than titanium oxide | 10 | 0.021 | 0.05 | Premix | 102 | D | E |
| Comparative Example 8 | Ti—6Al—4V | 20 | Silicon oxide | Lower than titanium oxide | 150 | 0.750 | 0.10 | Premix | 105 | D | F |
| Reference Example 2 | Molten material of Ti—6Al—4V | | — | — | — | — | — | — | — | — | D |

TABLE 3

| | Producing condition for titanium sintered body | | | | | | | | | | |
|---|---|---|---|---|---|---|---|---|---|---|---|
| | Titanium-based powder | | Ceramic powder | | | | | | Melt viscosity of injection molding composition | Evaluation result of titanium sintered body | |
| | Composition — | Average particle diameter μm | Composition — | Standard free energy of formation — | Average particle diameter nm | Particle diameter ratio % | Content mass % | Mixing method — | Pa · s | Surface properties — | Tensile strength — |
| Example 26 | Ti—6Al—7Nb | 25 | Silicon oxide | Lower than titanium oxide | 10 | 0.040 | 0.03 | Premix | 92 | A | B |
| Example 27 | Ti—6Al—7Nb | 25 | Silicon oxide | Lower than titanium oxide | 10 | 0.040 | 0.05 | Premix | 86 | A | A |
| Example 28 | Ti—6Al—7Nb | 25 | Silicon oxide | Lower than titanium oxide | 10 | 0.040 | 0.10 | Premix | 84 | A | A |
| Example 29 | Ti—6Al—7Nb | 25 | Aluminum oxide | Higher than titanium oxide | 50 | 0.200 | 0.05 | Premix | 98 | C | D |
| Example 30 | Ti—6Al—7Nb | 25 | Silicon nitride | — | 10 | 0.040 | 0.05 | Premix | 87 | C | D |
| Example 31 | Ti—6Al—7Nb | 25 | Silicon oxide | Lower than titanium oxide | 10 | 0.040 | 0.05 | Batch mixing | 93 | B | C |

TABLE 3-continued

| | Producing condition for titanium sintered body | | | | | | | | | | |
|---|---|---|---|---|---|---|---|---|---|---|---|
| | Titanium-based powder | | Ceramic powder | | | | | | Melt viscosity of injection molding composition | Evaluation result of titanium sintered body | |
| | Composition — | Average particle diameter μm | Composition — | Standard free energy of formation — | Average particle diameter nm | Particle diameter ratio % | Content mass % | Mixing method — | Pa · s | Surface properties — | Tensile strength — |
| Comparative Example 9 | Ti—6Al—7Nb | 9 | — | — | — | — | — | — | 108 | D | D |
| Comparative Example 10 | Ti—6Al—7Nb | 9 | Silicon oxide | Lower than titanium oxide | 10 | 0.111 | 0.05 | Premix | 104 | D | E |
| Comparative Example 11 | Ti—6Al—7Nb | 45 | Silicon oxide | Lower than titanium oxide | 10 | 0.022 | 0.05 | Premix | 105 | D | E |
| Comparative Example 12 | Ti—6Al—7Nb | 25 | Silicon oxide | Lower than titanium oxide | 150 | 0.600 | 0.10 | Premix | 106 | D | F |
| Reference Example 3 | Molten material of Ti—6Al—7Nb | | — | — | — | — | — | — | — | — | D |

As is clear from Tables 1 to 3, the titanium sintered body of each of Examples had better surface properties than the titanium sintered body of each of Comparative Examples. Therefore, the titanium sintered body of each of Examples is excellent in aesthetic appearance and is preferably used for various applications.

The titanium sintered body of each of Examples had a tensile strength equal to or greater than that of the titanium sintered body of each of Comparative Examples.

What is claimed is:

1. An injection molding composition comprising:

a titanium-based alloy powder containing titanium as a main component, wherein the titanium-based alloy powder has an average particle diameter of 15 μm or more and 35 μm or less;

a ceramic powder containing a ceramic as a main material, wherein an average particle diameter of the ceramic powder is 0.02% or more and 0.40% or less of the average particle diameter of the titanium-based alloy powder, the ceramic is an oxide-based ceramic containing an oxide as a main component, and a standard free energy of formation of the oxide at 1000° C. is lower than a standard free energy of formation of titanium oxide at 1000° C.; and an organic binder.

2. The injection molding composition according to claim 1, wherein the oxide is silicon oxide.

3. The injection molding composition according to claim 1, wherein a ratio of the ceramic powder in a total amount of the titanium-based alloy powder and the ceramic powder is 0.01 mass % or more and 0.30 mass % or less.

4. The injection molding composition according to claim 1, wherein a melt viscosity at a measurement weight of 100 g, a measurement temperature of 150° C., and a measurement speed of 100 mm/min is 50 Pas or more and 100 Pas or less.

* * * * *